US005244130A

United States Patent [19]

Ozeki et al.

[11] Patent Number: 5,244,130

[45] Date of Patent: Sep. 14, 1993

[54] MOLTEN STEEL POURING NOZZLE

[75] Inventors: Hidekichi Ozeki; Takafumi Aoki, both of Gifu; Kikuo Ariga, Mizunami, all of Japan

[73] Assignee: Akechi Ceramics Co., Ltd., Gifu, Japan

[21] Appl. No.: 998,406

[22] Filed: Dec. 29, 1992

[30] Foreign Application Priority Data

Jan. 27, 1992 [JP] Japan ..... 4-37091

[51] Int. Cl.[5] ..... B22D 41/08

[52] U.S. Cl. ..... 222/607; 222/606; 501/104

[58] Field of Search ..... 222/606, 607; 266/236; 501/104, 106

[56] References Cited

U.S. PATENT DOCUMENTS

| | | | |
|---|---|---|---|
| 3,722,821 | 3/1973 | Jaeger et al. | 501/104 |
| 4,780,434 | 10/1988 | Watanabe et al. | 501/104 |
| 4,989,762 | 2/1991 | Ando et al. | 501/104 |
| 5,086,957 | 2/1992 | Ozeki et al. | 222/607 |

FOREIGN PATENT DOCUMENTS

| | | |
|---|---|---|
| 64-40154 | 2/1989 | Japan . |
| 3-221249 | 9/1991 | Japan . |

*Primary Examiner*—S. Kastler

*Attorney, Agent, or Firm*—Frishauf, Holtz, Goodman & Woodward

[57] ABSTRACT

A molten steel pouring nozzle having, along the axis thereof, a bore through which molten steel flows. At least part of an inner portion of the molten steel pouring nozzle, which inner portion forms the bore, is formed of a refractory consisting essentially of:

| | |
|---|---|
| zirconia clinker comprising calcium zirconate | from 40 to 89 wt.%, |
| where, a content of calcium oxide in the zirconia clinker being within a range of from 6 to 35 weight parts relative to 100 weight parts of the zirconia clinker; | |
| graphite | from 10 to 35 wt.%, |
| and | |
| crystal stabilized calcium silicate comprising dicalcium silicate ($2CaO.SiO_2$) and tricalcium silicate ($3CaO.SiO_2$) | from 1 to 30 wt.%. |

4 Claims, 1 Drawing Sheet

MOLTEN STEEL POURING NOZZLE

REFERENCE TO PATENTS, APPLICATIONS AND PUBLICATIONS PERTINENT TO THE INVENTION

As far as we know, there are available the following prior art documents pertinent to the present invention:

(1) Japanese Patent Provisional Publication No. 64-40,154 published on Feb. 10, 1989; and (2) Japanese Patent Provisional Publication No. 3-221,249 published on Sep. 30, 1991.

The contents of the prior arts disclosed in the above-mentioned prior art documents will be discussed hereafter under the heading of the "BACKGROUND OF THE INVENTION".

BACKGROUND OF THE INVENTION

1. Field of the Invention

The present invention relates to a molten steel pouring nozzle which permits effective prevention of reduction or clogging of a bore of the nozzle, through which molten steel flows, when continuously casting an aluminum-killed molten steel containing aluminum.

2. Related Art Statement

A continuous casting of molten steel is carried out, for example, by pouring molten steel received from a ladle into a tundish, through a molten steel pouring nozzle secured to a bottom wall of the tundish, into a vertical mold arranged below the molten steel pouring nozzle, to form a cast steel strand, and continuously withdrawing the thus formed cast steel strand into a long strand.

As the above-mentioned molten steel pouring nozzle, a nozzle comprising an alumina-graphite refractory is widely used in general.

However, the molten steel pouring nozzle comprising an alumina-graphite refractory has the following problems:

When casting an aluminum-killed molten steel, aluminum added as a deoxidizer into molten steel reacts with oxygen present in molten steel to produce non-metallic inclusions such as α-alumina. The thus produced non-metallic inclusions such as α-alumina adhere and accumulate onto the surface of the bore of the molten steel pouring nozzle, through which molten steel flows, to clog up the bore, thus making it difficult to achieve a stable casting for long period of time. Furthermore, the non-metallic inclusions such as α-alumina, thus accumulated onto the surface of the bore, peel off or fall down, and are entangled into the cast steel strand, thus degrading the quality of the cast steel strand.

For the purpose of preventing the above-mentioned reduction or clogging of the bore of the molten steel pouring nozzle caused by the non-metallic inclusions such as α-alumina present in molten steel, there is popularly used a method which comprises ejecting an inert gas from the surface of the bore of the molten steel pouring nozzle toward molten steel flowing through the bore, to prevent the non-metallic inclusions such as α-alumina present in molten steel from adhering and accumulating onto the surface of the bore.

However, the above-mentioned method, in which an inert gas is ejected from the surface of the bore of the molten steel pouring nozzle toward molten steel flowing through the bore, has the following problems:

A larger amount of the ejected inert gas causes entanglement of bubbles produced by the inert gas into the cast steel strand, resulting in the production of defects such as pinholes in a steel product after the completion of rolling. This problem is particularly serious in the casting of molten steel for a high-quality thin steel sheet. A smaller amount of the ejected inert gas causes, on the other hand, adhesion and accumulation of the non-metallic inclusions such as α-alumina onto the surface of the bore of the molten steel pouring nozzle, thus causing reduction or clogging of the bore. In the casting of molten steel for a long period of time, a stable control of the amount of the ejected inert gas from the surface of the bore of the molten steel pouring nozzle becomes gradually more difficult, according as a structure of the refractory forming the molten steel pouring nozzle degrades As a result, the non-metallic inclusions such as α-alumina adhere and accumulate onto the surface of the bore of the molten steel pouring nozzle, thus causing reduction or clogging of the bore. Furthermore, in the casting of molten steel for a long period of time, a local erosion of the surface of the bore of the molten steel pouring nozzle is considerably accelerated by the ejected inert gas. This makes it impossible to continue the ejection of the inert gas and may cause rapid clogging of the bore.

With a view to preventing reduction or clogging of the bore of the molten steel pouring nozzle without the use of a mechanical means such as the ejection of an inert gas as described above, there is disclosed in Japanese Patent Provisional Publication No. 64-40,154 published on Feb. 10, 1989, a molten steel pouring nozzle formed of a refractory consisting essentially of:

| | |
|---|---|
| graphite: | from 10 to 40 wt. %, |
| calcium zirconate: | from 60 to 90 wt. %, |
| | where, a content of calcium oxide in said calcium zirconate being within a range of from 23 to 36 weight parts relative to 100 weight parts of said calcium zirconate. |

(hereinafter referred to as the "prior art 1").

where, a content of calcium oxide in said calcium zirconate being within a range of from 23 to 36 weight parts relative to 100 weight parts of said calcium zirconate. (hereinafter referred to as the "prior art 1").

However, the above-mentioned molten steel pouring nozzle of the piror art 1 has the following problems:

Calcium oxide (CaO) rapidly reacts with non-metallic inclusions such as α-alumina, which are produced through the reaction of aluminum added as a deoxidizer with oxygen present in molten steel, to produce low-melting-point compounds. Calcium oxide has therefore a function of preventing the non-metallic inclusions such as α-alumina from adhering and accumulating onto the surface of the bore of the nozzle.

However, calcium oxide, when present alone, violently reacts with water or moisture in the air even at a room temperature to produce calcium hydroxide ($Ca(OH)_2$), which easily disintegrates and tends to become powdery, thus leading to easy degradation of the structure of the molten steel pouring nozzle. Careful attention is therefore required for storing the molten steel pouring nozzle. Furthermore, because of a large thermal expansion coefficient of calcium oxide, a considerable thermal stress is produced in the interior of the molten steel pouring nozzle when calcium oxide is present alone and subjected to heating to such an extent as to cause a non-uniform temperature distribution, thus degrading thermal shock resistance of the molten steel pouring nozzle.

For the problems as described above, it is difficult to use the molten steel pouring nozzle made of a refractory, in which calcium oxide is present alone, for a long period of time for the continuous casting of molten steel.

For the purpose of overcoming the above-mentioned problems encountered in the molten steel pouring nozzle, in which calcium oxide is present alone, the molten steel pouring nozzle of the prior art 1 is formed of a refractory mainly comprising calcium zirconate. Therefore, it is true that contact of calcium oxide contained in calcium zirconate with the produced non-metallic inclusions such as α-alumina causes the acceleration of reaction between these components, thus producing low-melting-point compounds. Since calcium oxide is not present alone, no degradation of the structure of the molten steel pouring nozzle is caused. In the prior art 1, however, calcium oxide contained in calcium zirconate does not sufficiently move toward the surface of the bore of the molten steel pouring nozzle, through which molten steel flows, so that calcium oxide does not come into sufficient contact with the produced non-metallic inclusions such as α-alumina. As a result, the production of low-melting-point compounds caused by the reaction between calcium oxide and the non-metallic inclusions such as α-alumina is insufficient. Therefore, it is impossible to effectively prevent adhesion and accumulation of the non-metallic inclusions such as α-alumina onto the surface of the bore of the molten steel pouring nozzle.

Furthermore, with a view to preventing reduction or clogging of the bore of the molten steel pouring nozzle without the use of a mechanical means such as the ejection of an inert gas, there is disclosed in Japanese Patent Provisional Publication No. 3-221,249 published on Sep. 30, 1991, which corresponds to the U.S. Pat. No. 5,086,957 granted on Feb. 11, 1991, another molten steel pouring nozzle formed of a refractory consisting essentially of:

| | |
|---|---|
| zirconia clinker comprising calcium zirconate: | from 40 to 89 wt. %, where, a content of calcium oxide in said zirconia clinker being within a range of from 8 to 35 weight parts relative to 100 weight parts of said zirconia clinker; |
| graphite: | from 10 to 35 wt. %, |
| and | |
| calcium metasilicate ($CaO.SiO_2$): | from 1 to 25 wt. %, where, a content of calcium oxide in said calcium metasilicate being within a range of from 40 to 54 weight parts relative to 100 weight parts of said calcium metasilicate. |

(hereinafter referred to as the "prior art 2").

However, the above-mentioned molten steel pouring nozzle of the prior art 2 has the following problems:

It is true that calcium oxide (CaO) contained in calcium metasilicate ($CaO.SiO_2$) never violently reacts with water or moisture in the air. Furthermore, when the zirconia clinker comprising calcium zirconate coexists with calcium metasilicate ($CaO.SiO_2$), calcium oxide in each particle of the zirconia clinker tends to easily move toward the surface of each particle of the zirconia clinker under the effect of the coexisting calcium metasilicate ($CaO.SiO_2$). As a result, calcium oxide rapidly reacts with non-metallic inclusions such as α-alumina contained in molten steel to produce low-melting point compounds, thus preventing reduction or clogging of the bore of the nozzle.

However, because of the low content of calcium oxide, calcium metasilicate ($CaO.SiO_2$) cannot sufficiently replenish calcium oxide which reacts with the non-metallic inclusions such as α-alumina in molten steel, thus making it impossible to prevent reduction or clogging of the bore of the nozzle for a long period of time. If calcium metasilicate ($CaO.SiO_2$) is added to the refractory in a large quantity to increase the content of calcium oxide, on the other hand, the high contents of impurities contained in calcium metasilicate ($CaO.SiO_2$) causes degradation of spalling resistance of the molten steel pouring nozzle.

Under such circumstances, there is a strong demand for the development of a molten steel pouring nozzle which permits prevention of reduction or clogging of the bore of the nozzle and degradation of the structure of the refractory forming the nozzle economically and for a long period of time without the use of a mechanical means such as the ejection of an inert gas, but such a molten steel pouring nozzle has not as yet been proposed.

SUMMARY OF THE INVENTION

An object of the present invention is therefore to provide a molten steel pouring nozzle which permits prevention of reduction or clogging of the bore of the nozzle and degradation of the structure of the refractory forming the nozzle economically and for a long period of time without the use of a mechanical means such as the ejection of an inert gas.

In accordance with one of the features of the present invention, there is provided a molten steel pouring nozzle having, along the axis thereof, a bore through which molten steel flows, wherein:

at least part of an inner portion of said molten steel pouring nozzle, which inner portion forms said bore, is formed of a refractory consisting essentially of:

| | |
|---|---|
| zirconia clinker comprising calcium zirconate | from 40 to 89 wt.%, |
| where, a content of calcium oxide in said zirconia clinker being within a range of from 8 to 35 weight parts relative to 100 weight parts of said zirconia clinker; | |
| graphite | from 10 to 35 wt.%; |
| and | |
| crystal stabilized calcium silicate comprising dicalcium silicate ($2CaO.SiO_2$) and tricalcium silicate ($3CaO.SiO_2$) | from 1 to 30 wt.%, |
| where, contents of calcium oxide, silica and boron oxide as a stabilizer in said crystal stabilized calcium silicate being respectively within the following ranges relative to 100 weight parts of said crystal stabilized calcium silicate: | |
| calcium oxide | from 62 to 73 weight parts, |
| silica | from 26 to 34 weight parts, |
| and | |
| boron oxide | from 1 to 5 weight parts, |
| where, the total content of said calcium oxide, said silica and said boron oxide being at least 95 weight parts. | |

DETAILED DESCRIPTION OF PREFERRED EMBODIMENTS

Figure 1:
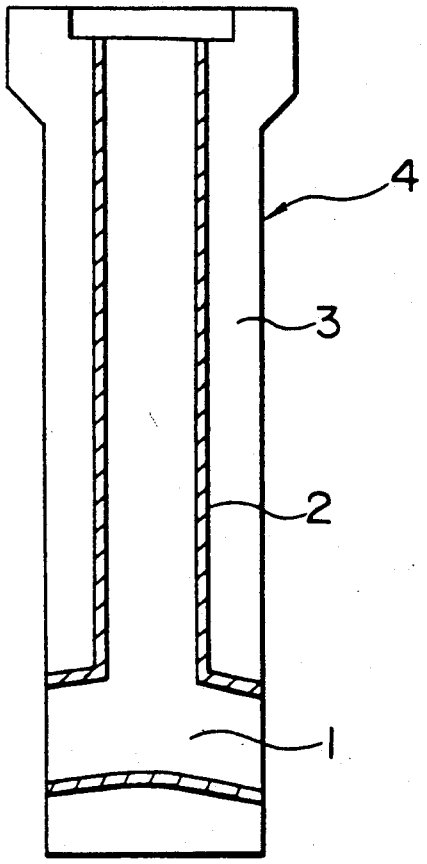
FIG. 1 is a schematic vertical sectional view illustrating a first embodiment of the molten steel pouring nozzle of the present invention as an immersion nozzle.

From the above-mentioned point of view, extensive studies were carried out to develop a molten steel pouring nozzle which permits prevention of reduction or clogging of the bore of the nozzle and degradation of the structure of the refractory forming the nozzle economically and for a long period of time without the use of a mechanical means such as the ejection of an inert gas.

As a result, the following findings were obtained: by forming a molten steel pouring nozzle with the use of a refractory containing zirconia clinker which comprises calcium zirconate, it is possible to inhibit a violent reaction of calcium oxide with water or moisture in the air, thus preventing degradation of the structure of the molten steel pouring nozzle. More particularly, zirconia clinker comprising calcium zirconate and having a prescribed particle size is prepared by melting calcium oxide and zirconia in an electric furnace at a high temperature of at least 1,600° C., then cooling the resultant melt to solidify same, and then pulverizing the resultant solid. The thus prepared zirconia clinker, which comprises calcium zirconate ($CaO.ZrO_2$), is stable similarly to stabilized zirconia, and has a low thermal expansion coefficient, and inhibits a violent reaction of calcium oxide with water or moisture in the air, thus preventing degradation of the structure of the molten steel pouring nozzle.

Furthermore, when the above-mentioned zirconia clinker comprising calcium zirconate coexists with crystal stabilized calcium silicate (a mixture of $2CaO.SiO_2$ and $3CaO.SiO_2$), calcium oxide in each particle of zirconia clinker tends to easily move toward the surface of each particle of zirconia clinker under the effect of the above-mentioned coexisting crystal stabilized calcium silicate. In other words, calcium oxide, which is to react with α-alumina in molten steel, which is the main constituent of the non-metallic inclusions adhering onto the surface of the bore of the molten steel pouring nozzle, moves toward the surface of each particle of zirconia clinker and gathers there.

Furthermore, in addition to the above-mentioned function, crystal stabilized calcium silicate has a function of sufficiently replenishing the quantity of calcium oxide, which is to react with α-alumina in molten steel, because of the high content of calcium oxide.

Moreover, although tricalcium silicate ($3CaO.SiO_2$) and dicalcium silicate ($2CaO.SiO_2$) contain calcium oxide in a large quantity, a rapid change in temperature causes transformation of the crystals of tricalcium silicate and dicalcium silicate into the γ-phase, thus degrading the structure of the nozzle. To the contrary, since the crystals of crystal stabilized calcium silicate (a mixture of $2CaO.SiO_2$ and $3CaO.SiO_2$) does not transform into the γ-phase even with a rapid change in temperature, there occurs no abnormal expansion or contraction, and degradation of the nozzle structure never occurs.

It is thus possible to inhibit a violent reaction of calcium oxide with water or moisture in the air, facilitate the reaction between calcium oxide and the non-metallic inclusions such as α-alumina, permit such reaction to continue for a long period of time to produce low-melting-point compounds such as $CaO.Al_2O_3$ and $3CaO.Al_2O_3$, and thus to effectively prevent, for a long period of time, the non-metallic inclusions such as α-alumina from adhering and accumulating onto the surface of the bore of the molten steel pouring nozzle.

The present invention was made on the basis of the above-mentioned findings. At least part of an inner portion of the molten steel pouring nozzle of the present invention, which inner portion forms a bore thereof, is formed of a refractory consisting essentially of:

| | |
|---|---|
| zirconia clinker comprising calcium zirconate | from 40 to 89 wt.%, |
| where, a content of calcium oxide in said zirconia clinker being within a range of from 8 to 35 weight parts relative to 100 weight parts of said zirconia clinker; | |
| graphite | from 10 to 35 wt.%; |
| and | |
| crystal stabilized calcium silicate comprising dicalcium silicate ($2CaO.SiO_2$) and tricalcium silicate ($3CaO.SiO_2$) | from 1 to 30 wt.%, |
| where, contents of calcium oxide, silica and boron oxide as a stabilizer in said crystal stabilized calcium silicate being respectively within the following ranges relative to 100 weight parts of said crystal stabilized calcium silicate: | |
| calcium oxide | from 62 to 73 weight parts, |
| silica | from 26 to 34 weight parts, |
| and | |
| boron oxide | from 1 to 5 weight parts, |
| where, the total content of said calcium oxide, said silica and said boron oxide being at least 95 weight parts. | |

Now, the following paragraphs describe the reasons of limiting the chemical composition of the refractory forming at least part of an inner portion of the molten steel pouring nozzle of the present invention, which inner portion forms a bore thereof, as described above.

(1) Zirconia clinker comprising calcium zirconate:

Zirconia clinker has a low thermal expansion coefficient and is excellent in spalling resistance. With a content of zirconia clinker of under 40 wt. %, however, the amount of calcium oxide, which is to react with the non-metallic inclusions such as α-alumina in molten steel, becomes insufficient, thus making it impossible to prevent adhesion and accumulation of the non-metallic inclusions such as α-alumina onto the surface of the bore of the molten steel pouring nozzle. With a content of zirconia clinker of over 89 wt. %, on the other hand, there occurs abnormality in the thermal expansion coefficient at a temperature of at least about 900° C., and spalling resistance is deteriorated. The content of zirconia clinker should therefore be limited within a range of from 40 to 89 wt. %. Zirconia clinker should preferably have an average particle size of up to 44 μm in order to ensure a satisfactory surface smoothness of the nozzle.

(2) Calcium oxide contained in zirconia clinker comprising calcium zirconate:

Calcium oxide contained in zirconia clinker, of which the property of violently reacting with water or moisture in the air is largely decreased, reacts with the non-metallic inclusions such as α-alumina in molter steel to produce the low-melting-point compounds. However, with a content of calcium oxide in zirconia clinker of under 8 weight parts relative to 100 weight parts of zirconia clinker, a desired effect as described above is unavailable, and the presence of buddeleyite ($ZrO_2$) in zirconia clinker causes degradation of the structure of the molten steel pouring nozzle. With a content of calcium oxide in zirconia clinker of over 35 weight parts relative to 100 weight parts of zirconia clinker, on the other hand, calcium oxide, which is not dissolved into calcium zirconate, and reacts violently with water or moisture in the air, and has a high thermal expansion coefficient, is present alone in zirconia clinker, resulting in degradation of the structure of the molten steel pouring nozzle. The content of calcium oxide in zirconia clinker should therefore be limited within a range of from 8 to 35 weight parts relative to 100 weight parts of zirconia clinker.

(3) Graphite:

Graphite has a function of improving oxidation resistance of a refractory and wetting resistance thereof against molten steel, and increasing thermal conductivity of the refractory. Particularly, natural graphite is suitable for obtaining the above-mentioned function. With a content of graphite of under 10 wt. %, however, a desired effect as described above cannot be obtained, and spalling resistance is poor. With a content of graphite of over 35 wt. %, on the other hand, corrosion resistance is degraded. The content of graphite should therefore be limited within a range of from 10 to 35 wt. %. Graphite should preferably have an average particle size of up to 500 μm with a view to improving the above-mentioned function.

(4) Crystal stabilized calcium silicate:

Crystal stabilized calcium silicate (a mixture of $2CaO.SiO_2$ and $3CaO.SiO_2$) has a function of promoting calcium oxide in each particle of zirconia clinker to move toward the surface of each particle of zirconia clinker and to gather there. Crystal stabilized calcium silicate has furthermore a function of sufficiently replenishing the quantity of calcium oxide, which is to react with the non-metallic inclusions such as α-alumina in molten steel. With a content of crystal stabilized calcium silicate of under 1 wt. %, however, a desired effect as described above cannot be obtained. With a content of crystal stabilized calcium silicate of over 30 wt. %, on the other hand, the structure of the refractory is degraded, thus leading to a lower corrosion resistance and a lower refractoriness. The content of crystal stabilized calcium silicate should therefore be limited within a range of from 1 to 30 wt. %. With a view to improving the above-mentioned functions of crystal stabilized calcium silicate and achieving a satisfactory surface smoothness of the nozzle, crystal stabilized calcium silicate should preferably have an average particle size of up to 44 μm.

Crystal stabilized calcium silicate comprises calcium oxide, silica and boron oxide as a stabilizer. Crystal stabilized calcium silicate is prepared by mixing calcined lime, silica sand and boric acid, melting the resultant mixture in an electric furnace at a high temperature of at least 1,500° C., then cooling the resultant melt to solidify same, and then pulverizing the resultant solid to obtain crystal stabilized calcium silicate having a prescribed particle size.

When the contents of calcium oxide, silica and boron oxide in crystal stabilized calcium silicate are respectively within the following ranges relative to 100 weight parts of crystal stabilized calcium silicate:

| | |
|---|---|
| calcium oxide | from 62 to 73 weight parts, |
| silica | from 26 to 34 weight parts, |
| and | |
| boron oxide | from 1 to 5 weight parts, |

where, the total content of calcium oxide, silica and boron oxide being at least 95 weight parts, the violent reaction of calcium oxide with water or moisture in the air is inhibited, and the crystals of crystal stabilized calcium silicate do not transform into the γ-phase even with a rapid change in temperature, so that the structure of the molten steel pouring nozzle is never deteriorated. The contents of calcium oxide, silica and boron oxide in crystal stabilized calcium silicate should therefore be limited respectively within the above-mentioned ranges relative to 100 weight parts of crystal stabilized calcium silicate.

For the purpose of further improving spalling resistance and oxidation resistance of the refractory forming the molten steel pouring nozzle, silicon carbide may additionally be added.

For the purpose of making the above-mentioned functions of crystal stabilized calcium silicate more effective, silica and/or magnesia may additionally be added.

Now, embodiments of the molten steel pouring nozzle of the present invention are described with reference to the drawings.

FIG. 1 is a schematic vertical sectional view illustrating a first embodiment of the molten steel pouring nozzle of the present invention as an immersion nozzle.

A molten steel pouring nozzle 4 of the first embodiment is used as an immersion nozzle which is arranged between a tundish and a vertical mold arranged below the tundish. As shown in FIG. 1, the molten steel pouring nozzle 4 of the first embodiment of the present invention has, along the axis thereof, a bore 1 through which molten steel flows. An inner portion 2 of the molten steel pouring nozzle 4, which forms the bore 1, is formed of a refractory having the above-mentioned chemical composition. An outer portion 3 surrounding the inner portion 2 is formed of a refractory, for example, an alumina-graphite refractory having an excellent erosion resistance against molten steel. According to the above-mentioned molten steel pouring nozzle 4, it is possible to prevent for a long period of time adhesion and accumulation of the non-metallic inclusions such as α-alumina present in molten steel onto the surface of the inner portion 2 of the molten steel pouring nozzle 4, which forms the bore 1.

Figure 2:
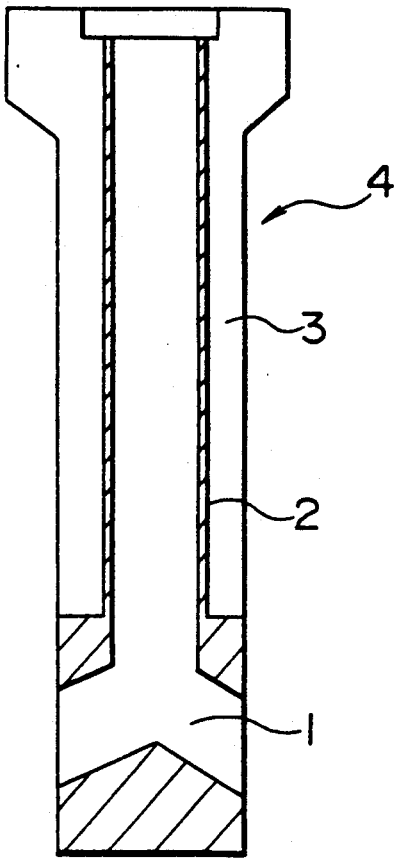
FIG. 2 is a schematic vertical sectional view illustrating a second embodiment of the molten steel pouring nozzle of the present invention as an immersion nozzle.

FIG. 2 is a schematic vertical sectional view illustrating a second embodiment of the molten steel pouring nozzle of the present invention as an immersion nozzle.

As shown in FIG. 2, a molten steel pouring nozzle 4 of the second embodiment of the present invention is identical in the construction to the above-mentioned molten steel pouring nozzle 4 of the first embodiment of the present invention, except that the whole of a lower portion of the molten steel pouring nozzle 4, which forms a lower portion of a bore 1, is formed of a refractory having the above-mentioned chemical composition. Therefore, the same reference numerals are assigned to the same components as those in the first embodiment, and the description thereof is omitted.

The molten steel pouring nozzle 4 of the second embodiment has a service life longer than that of the molten steel pouring nozzle 4 of the first embodiment, since the refractory having the above-mentioned chemical composition, which forms the lower portion of the bore 1, where the reaction between calcium oxide and the non-metallic inclusions such as α-alumina takes place most actively, has a sufficient thickness as shown in FIG. 2.

Now, the molten steel pouring nozzle of the present invention is described more in detail by means of an example.

EXAMPLE

First, a mixture comprising calcium oxide (CaO) and zirconia ($ZrO_2$) was melted in an electric furnace at a temperature of at least 1,600° C. Then, the resultant melt was cooled to a room temperature to solidify same, and then, the resultant solid was pulverized in a ball mill to prepare zirconia clinker comprising calcium zirconate ($CaO.ZrO_2$) and having an average particle size of up to 40 μm. The content of calcium oxide in the thus prepared zirconia clinker was within a range of from 8 to 35 weight parts relative to 100 weight parts of zirconia clinker.

Then, a mixture comprising calcined lime (CaO), silica sand ($SiO_2$) and boric acid was melted in an electric furnace at a temperature of at least 1,500° C. Then, the resultant melt was cooled to a room temperature to solidify same, and then, the resultant solid was pulverized in a ball mill to prepare crystal stabilized calcium silicate having an average particle size of up to 44 μm. The contents of calcium oxide, silica and boron oxide in the thus prepared crystal stabilized calcium silicate were within respective ranges from 62 to 73 weight parts, from 26 to 34 weight parts, and from 1 to 5 weight parts relative to 100 weight parts of crystal stabilized calcium silicate. The total content of these calcium oxide, silica and boron oxide was at least 95 weight parts.

Then, phenol resin in the state of powder or liquid was added in an amount within a range of from 5 to 10 wt. % to each of blended raw materials Nos. 1 to 5 including the above-mentioned zirconia clinker comprising calcium zirconate and the above-mentioned crystal stabilized calcium silicate, which had the chemical compositions within the scope of the present invention as shown in Table 1. Each of these blended raw materials Nos. 1 to 5 added with phenol resin was mixed and kneaded to obtain a kneaded mass. A pilaster-like formed body having dimensions of 30 mm×30 mm×230 mm for testing an amount of adhesion of the non-metallic inclusions such as α-alumina and corrosion resistance against molten steel, and a tubular formed body having an outside diameter of 100 mm, an inside diameter of 60 mm and a length of 250 mm for testing spalling resistance, were formed from each of the thus obtained kneaded masses. Then, these formed bodies were reduction-fired at a temperature within a range of from 1,000° to 1,200° C. to prepare samples within the scope of the present invention (hereinafter referred to as the "samples of the invention") Nos. 1 to 5.

Then, phenol resin in the state of powder or liquid was added in an amount within a range of from 5 to 10 wt. % to each of blended raw materials Nos. 6 to 11, having the chemical compositions outside the scope of the present invention as shown in Table 1. Each of these blended raw materials Nos. 6 to 11 added with phenol resin was mixed and kneaded to obtain a kneaded mass. A pilaster-like formed body having dimensions of 30 mm×30 mm×230 mm for testing an amount of adhesion of the non-metallic inclusions such as α-alumina and corrosion resistance against molten steel, and a tubular formed body having an outside diameter of 100 mm, an inside diameter of 60 mm and a length of 250 mm for testing spalling resistance, were formed from each of the thus obtained kneaded masses. Then, these formed bodies were reduction-fired at a temperature within a range of from 1,000° to 1,200° C. to prepare samples outside the scope of the present invention (hereinafter referred to as the "samples for comparison") Nos. 6 to 11.

TABLE 1

(wt. %)

| Chemical Composition of blended raw materials | Sample of the invention | | | | | Sample for comparison | | | | | |
|---|---|---|---|---|---|---|---|---|---|---|---|
| | No. 1 | No. 2 | No. 3 | No. 4 | No. 5 | No. 6 | No. 7 | No. 8 | No. 9 | No. 10 | No. 11 |
| Zirconia clinker comprising calcium zirconate (44 μm) | 79 | 75 | 70 | 60 | 45 | 90 | 45 | 50 | — | — | 50 |
| Graphite (500 μm) | 20 | 20 | 20 | 20 | 25 | 10 | 20 | 40 | 20 | 20 | 20 |
| Crystal stabilized calcium silicate (44 μm) | 1 | 5 | 10 | 20 | 30 | — | 35 | 10 | — | — | — |
| Calcium metasilicate (44 μm) | — | — | — | — | — | — | — | — | — | — | 30 |
| Cubic zirconia | — | — | — | — | — | — | — | — | 55 | — | — |
| Baddeleyite | — | — | — | — | — | — | — | — | 15 | — | — |
| Silicon carbide | — | — | — | — | — | — | — | — | 10 | 5 | — |
| Alumina | — | — | — | — | — | — | — | — | — | 75 | — |

For each of the above-mentioned samples of the invention Nos. 1 to 5 and the samples for comparison Nos. 6 to 11, bulk specific gravity and porosity were measured. The results are shown in Table 2.

Then, each of the tubular samples of the invention Nos. 1 to 5 and the tubular samples for comparison Nos. 6 to 11, which had an outside diameter of 100 mm, an inside diameter of 60 mm and a length of 250 mm, was heated in an electric furnace at a temperature of 1,500° C. for 30 minutes, and then, rapidly water-cooled to investigate spalling resistance. The results are shown in Table 2.

Subsequently, each of the pilaster-like samples of the invention Nos. 1 to 5 and the pilaster-like samples for comparison Nos. 6 to 11, which had dimensions of 30 mm×30 mm×230 mm, was immersed in molten steel at a temperature 1,550° C. containing aluminum in an amount within a range of from 0.03 to 0.05 wt. % for 180 minutes to investigate an erosion ratio(%) and an amount of adhesion (mm) of the non-metallic inclusions such as α-alumina. The results are also shown in Table 2.

TABLE 2

| Properties | Sample of the invention | | | | | Sample for comparison | | | | | |
|---|---|---|---|---|---|---|---|---|---|---|---|
| | No. 1 | No. 2 | No. 3 | No. 4 | No. 5 | No. 6 | No. 7 | No. 8 | No. 9 | No. 10 | No. 11 |
| Porosity (%) | 19.6 | 19.5 | 19.1 | 18.4 | 19.6 | 19.8 | 19.4 | 19.5 | 19.3 | 18.7 | 17.0 |
| Bulk specific gravity | 2.90 | 2.87 | 2.81 | 2.77 | 2.57 | 3.15 | 2.57 | 2.42 | 2.49 | 2.67 | 2.67 |
| Erosion ratio (%) | 7 | 9 | 10 | 15 | 20 | 3 | 40 | 30 | 3 | 3 | 26 |
| Spalling resistance | No crack | No crack | No crack | No crack | No crack | Crack occurrence | Crack occurrence | No crack | No crack | No crack | Crack occurrence |
| Amount of adhesion of alumina (mm) | Almost zero | Almost zero | Almost zero | Almost zero | Almost zero | 15 | Almost zero | Almost zero | 15 | 15 | Almost zero |

As is clear from Table 2, all the samples of the invention Nos. 1 to 5 showed a low erosion ratio, so that it was possible to avoid deterioration of the structure of the refractory. In addition, the samples of the invention Nos. 1 to 5 had an excellent spalling resistance and had no adhesion of the non-metallic inclusions such as α-alumina, thus permitting effective prevention of reduction or clogging of the bore of the molten steel pouring nozzle.

The samples for comparison Nos. 6 to 11 had in contrast a large amount of adhesion of the non-metallic inclusions such as α-alumina when the erosion ratio was low, whereas the samples for comparison Nos. 6 to 11 had a high erosion ratio when there was no adhesion of the non-metallic inclusions such as α-alumina. More specifically, the sample for comparison No. 6 was very poor in spalling resistance, since the content of zirconia clinker comprising calcium zirconate was high outside the scope of the present invention. In addition, the sample for comparison No. 6 had a large amount of adhesion of the non-metallic inclusions such as α-alumina, since crystal stabilized calcium silicate was not contained. The sample for comparison No. 7 was very poor in corrosion resistance against molten steel, since the content of crystal stabilized calcium silicate was high outside the scope of the present invention. The sample for comparison No. 8 was very poor in corrosion resistance against molten steel, since the graphite content was high outside the scope of the present invention, although both of the content of zirconia clinker comprising calcium zirconate and the content of crystal stabilized calcium silicate were within the scope of the present invention. The samples for comparison Nos. 9 and 10 had a large amount of adhesion of the non-metallic inclusions such as α-alumina, since neither zirconia clinker comprising calcium zirconate nor crystal stabilized calcium silicate was contained. The sample for comparison No. 11 was poor in spalling resistance, although there was no adhesion of the non-metallic inclusions such as α-alumina, since calcium metasilicate ($CaO.SiO_2$) was contained in a large amount instead of crystal stabilized calcium silicate.

According to the molten steel pouring nozzle of the present invention, as described above in detail, it is possible to stably inhibit reduction or clogging of the bore of the nozzle caused by adhesion of the non-metallic inclusions such as α-alumina for a long period of time without causing degradation of the structure of the refractory, thus providing many industrially useful effects.

What is claimed is:

1. A molten steel pouring nozzle having, along the axis thereof, a bore through which molten steel flows, wherein:

at least part of an inner portion of said molten steel pouring nozzle, which inner portion forms said bore, is formed of a refractory consisting essentially of:

| | |
|---|---|
| zirconia clinker comprising calcium zirconate | from 40 to 89 wt.%, |
| where, a content of calcium oxide in said zirconia clinker being within a range of from 8 to 35 weight parts relative to 100 weight parts of said zirconia clinker; | |
| graphite | from 10 to 35 wt.%; |
| and | |
| crystal stabilized calcium silicate comprising dicalcium silicate ($2CaO.SiO_2$) and tricalcium silicate ($3CaO.SiO_2$) | from 1 to 30 wt.%, |
| where, contents of calcium oxide, silica and boron oxide as a stabilizer in said crystal stabilized calcium silicate being respectively within the following ranges relative to 100 weight parts of said crystal stabilized calcium silicate: | |
| calcium oxide | from 62 to 73 weight parts, |
| silica | from 26 to 34 weight parts, |
| and | |
| boron oxide | from 1 to 5 weight parts, |
| where, the total content of said calcium oxide, said silica and said boron oxide being at least 95 weight parts. | |

2. A molten steel pouring nozzle as claimed in claim 1, wherein:

the whole of said molten steel pouring nozzle is formed of said refractory.

3. A molten steel pouring nozzle as claimed in claim 1, wherein:

said inner portion of said molten steel pouring nozzle, which inner portion forms said bore, is formed of said refractory.

4. A molten steel pouring nozzle as claimed in any one of claims 1 to 3, wherein:

said zirconia clinker has an average particle size of up to 44 μm; said graphite has an average particle size of up to 500 μm; and said crystal stabilized calcium silicate has an average particle size of up to 44 μm.

* * * * *